US011926988B2

(12) United States Patent
Wuisan et al.

(10) Patent No.: US 11,926,988 B2
(45) Date of Patent: Mar. 12, 2024

(54) WORK MACHINE WITH AUTOMATIC PITCH CONTROL OF IMPLEMENT

(71) Applicant: DEERE & COMPANY, Moline, IL (US)

(72) Inventors: Giovanni A. Wuisan, Epworth, IA (US); Jeffrey M. Stenoish, Asbury, IA (US); Patrick J. Mulligan, Dubuque, IA (US); Michael R. Tigges, Dubuque, IA (US); Ryan R. Neilson, Dubuque, IA (US); Nathan J. Horstman, Durango, IA (US); Cory J. Brant, Hazel Green, WI (US); Timothy M. Post, Potosi, WI (US)

(73) Assignee: DEERE & COMPANY, Moline, IL (US)

( * ) Notice: Subject to any disclaimer, the term of this patent is extended or adjusted under 35 U.S.C. 154(b) by 360 days.

(21) Appl. No.: 17/028,107

(22) Filed: Sep. 22, 2020

(65) Prior Publication Data

US 2022/0090349 A1 Mar. 24, 2022

(51) Int. Cl.

| | |
|---|---|
| ***E02F 3/76*** | (2006.01) |
| ***E02F 3/815*** | (2006.01) |
| ***E02F 3/84*** | (2006.01) |

(52) U.S. Cl.

CPC ..... *E02F 3/7618* (2013.01); *E02F 3/8152* (2013.01); *E02F 3/845* (2013.01)

(58) Field of Classification Search

CPC ..... E02F 3/7618; E02F 3/8152; E02F 3/845
See application file for complete search history.

(56) References Cited

U.S. PATENT DOCUMENTS

| | | | |
|---|---|---|---|
| 3,157,099 | A | 11/1964 | Ulrich |
| 4,099,578 | A | 7/1978 | Stevens |

(Continued)

FOREIGN PATENT DOCUMENTS

| | | | |
|---|---|---|---|
| DE | 102021208926 | A1 | 3/2022 |
| EP | 3521515 | A1 | 8/2019 |

OTHER PUBLICATIONS https://www.meiren.ee/en/snow-plows/snow-plow-vles-for-wheel-loader/; "W-snowplow VLES for wheel loader | Meiren snow plows"; pp. 1-7; Date Sep. 22, 2020.

(Continued)

*Primary Examiner* — Thomas B Will
*Assistant Examiner* — Joel F. Mitchell
(74) *Attorney, Agent, or Firm* — Taft Stettinius & Hollister LLP; Stephen F. Rost

(57) ABSTRACT

A system and method for automatically adjusting the pitch of a work implement attached to a work vehicle, wherein the work implement has adjustable wings. The system and method include moving materials with a blade having an adjustable wing located at one end of a center portion of the blade. blade operatively connected to the work vehicle is positionable with respect to the work vehicle in response to an operator command. A commanded position of the blade is identified based on a blade positioning signal received from the operator command transmitted by an operator control device. An inclined position of the adjustable wing with respect to the center portion of the blade is identified. A pitch of the blade with respect to the work vehicle based is automatically adjusted based on the identified commanded position of the blade and the identified inclined position of the adjustable wing.

18 Claims, 7 Drawing Sheets

(56) References Cited

U.S. PATENT DOCUMENTS

| | | | | |
|---|---|---|---|---|
| 4,135,583 | A | 1/1979 | Becker | |
| 4,356,645 | A * | 11/1982 | Hine et al. | E02F 3/7613 172/825 |
| 4,535,847 | A * | 8/1985 | Hasegawa et al. | E02F 3/844 172/446 |
| 5,987,371 | A * | 11/1999 | Bailey et al. | E02F 3/847 701/472 |
| 6,425,196 | B1 | 7/2002 | Weagley et al. | |
| 6,442,877 | B1 | 9/2002 | Quenzi et al. | |
| 8,919,455 | B2 | 12/2014 | Hendron et al. | |
| 9,151,006 | B2 | 10/2015 | Guggino et al. | |
| 9,328,479 | B1 * | 5/2016 | Rausch et al. | E02F 9/265 |
| 9,593,461 | B2 * | 3/2017 | Faivre et al. | E02F 9/2221 |
| 9,624,643 | B2 | 4/2017 | Hendron et al. | |
| 9,920,496 | B2 * | 3/2018 | Ummenhofer et al. | E02F 3/8155 |
| 10,132,050 | B1 | 11/2018 | Mandan | |
| 10,267,015 | B2 * | 4/2019 | Landry et al. | E01C 19/187 |
| 2011/0213529 | A1 * | 9/2011 | Krause et al. | E02F 3/431 701/50 |
| 2012/0059554 | A1 * | 3/2012 | Omelchenko et al. | E02F 3/845 701/50 |
| 2016/0230367 | A1 | 8/2016 | Hendron et al. | |
| 2016/0312421 | A1 | 10/2016 | Ummenhofer et al. | |
| 2017/0107700 | A1 | 4/2017 | Faivre et al. | |
| 2017/0218597 | A1 | 8/2017 | Holman | |

OTHER PUBLICATIONS http://www.domorequipment.com/r600c/; "R600C Mechanical Aggregate Spreader by DoMor"; pp. 1-5; Date: Sep. 22, 2020.

www.cat.com; 2015 Caterpillar; "Cat D6N Track-Type Tractor"; pp. 1-2.

Komatsu Ltd; Article "Bulldozers D61EX/PX-12"; pp. 1-12.

https://www.pistenbully.com/aut/en/vehicles/all-vehicles.html; "Snow Groomers"; Date: Sep. 22, 2020; pp. 1-18.

* cited by examiner

WORK MACHINE WITH AUTOMATIC PITCH CONTROL OF IMPLEMENT

FIELD OF THE DISCLOSURE

The present invention generally relates to a work machine having actuators to adjust an implement, and more particularly to a work vehicle having a control system and method to adjust a pitch of the implement.

BACKGROUND

Work vehicles are configured to perform a wide variety of tasks including use as construction vehicles, forestry vehicles, lawn maintenance vehicles, as well as on-road vehicles such as those used to plow snow, spread salt, or vehicles with towing capability. Additionally, work vehicles typically perform work with one or more implements that are moved by actuators in response to commands provided by a user of the work vehicle, or by commands that are generated automatically by a control system, either located within the vehicle or located externally to the vehicle.

In one example such as a bulldozer, the bulldozer is equipped with an implement, such as a blade, which is moved by actuators responsive to implement commands. The blade is used to move materials. To accomplish these tasks, the position of the blade is adjusted by one or more actuators. On a utility crawler dozer for instance, the blade is typically adjustable in different directions, which includes raising and lowering of the blade, adjusting a pitch position of the blade by moving the top portion of the blade forward and backward relative to a lower pivot point, an angle of the blade by moving one or the other end of the blade left or right about a center pivot point, and a tilt of the blade about a center pivot point to raise or lower one side of the blade or the other.

Other work vehicles include, but are not limited to, excavators, loaders, and motor graders. In motor graders, for instance, a drawbar assembly is attached toward the front of the grader, which is pulled by the grader as the grader moves forward. The drawbar assembly rotatably supports a circle drive member at a free end of the drawbar assembly and the circle drive member supports a work implement such as the blade, also known as a mold board. The angle of the work implement beneath the drawbar assembly can be adjusted by the rotation of the circle drive member relative to the drawbar assembly.

In addition, to the blade being rotated about a rotational fixed axis, the blade is also adjustable to a selected angle with respect to the circle drive member. This angle is known as blade slope. The elevation of the blade is also adjustable.

Different types of blades are known and include a single piece blade having a relatively straight front edge that engages the material being moved. Other blades include a single wing at an end of central portion of the blade, or two wings located at either end of a central portion of the blade. In a blade having one or two wings, each wing is either fixed at an inclined angle with respect to the central portion of the blade or is adjustable with respect to the central portion of the blade. In blades having movable wings, the adjustment of the wing reduces the length of the blade. By reducing the length of the blade, the overall width of the vehicle is reduced which can make transport of the vehicle less cumbersome.

Blades with the adjustable wing inclined with respect to the central portion are often used in certain plowing conditions to improve work efficiency. For instance, when the wing is angled with respect to the central portion in a grading operation, wind row spillover is reduced. The wing in the angled position provides a more productive machine by reducing the number of passes needed to complete a grading operation, resulting in more efficient use of the machine.

Grading operations, however, can be adversely affected when using a blade having wings angled with respect to the central portion. Depending on the position of the blade with respect to the surface, the cutting edge of the central portion of the blade may be the only portion of the blade in contact with the surface. In this situation, one or both of wings are not in contact with or cut too deeply into the surface being graded. As a result, additional passes are needed to complete a grading operation. What is needed therefore is a blade having wings and a control system to move a blade with wings to optimize the grading operation of a vehicle's blade.

SUMMARY

In one embodiment, there is provided a method of positioning a blade with respect to a work vehicle having an operator control to position the blade, wherein the blade has an adjustable wing. The method includes: identifying a position of the wing with respect to a central portion of the blade; identifying a blade position based on a blade positioning signal received from the operator control; and automatically adjusting the position of the blade based on the identified position of the wing and the identified blade positioning signal.

In another embodiment, there is provided a work vehicle including a chassis, a blade, and a linkage system connected to the chassis and to the blade, wherein the linkage system is configured to position of the blade with respect to the chassis. The work vehicle further includes an operator control and a controller operatively connected to the operator control and to the linkage system. The controller includes a processor and a memory, wherein the memory is configured to store program instructions. The processor is configured to execute the stored program instructions to: identify a position of the wing with respect to a central portion of the blade; identify a blade position based on a blade positioning signal received from the operator control; and automatically adjust the position of the blade based on the identified position of the wing and the identified blade positioning signal.

In a further embodiment, there is provided a method of moving materials with a blade having an adjustable wing located at one end of a center portion of the blade, wherein the blade is operatively connected to a work vehicle and is positionable with respect to the work vehicle in response to an operator command. The method includes: identifying a commanded position of the blade based on a blade positioning signal received from the operator command; identifying an inclined position of the adjustable wing with respect to the center portion of the blade; automatically adjusting a pitch of the blade with respect to the work vehicle based on the identified commanded position of the blade and the identified inclined position of the adjustable wing.

BRIEF DESCRIPTION OF THE DRAWINGS

The above-mentioned aspects of the present invention and the manner of obtaining them will become more apparent and the invention itself will be better understood by reference to the following description of the embodiments of the invention, taken in conjunction with the accompanying drawings, wherein.

DETAILED DESCRIPTION

Figure 1:
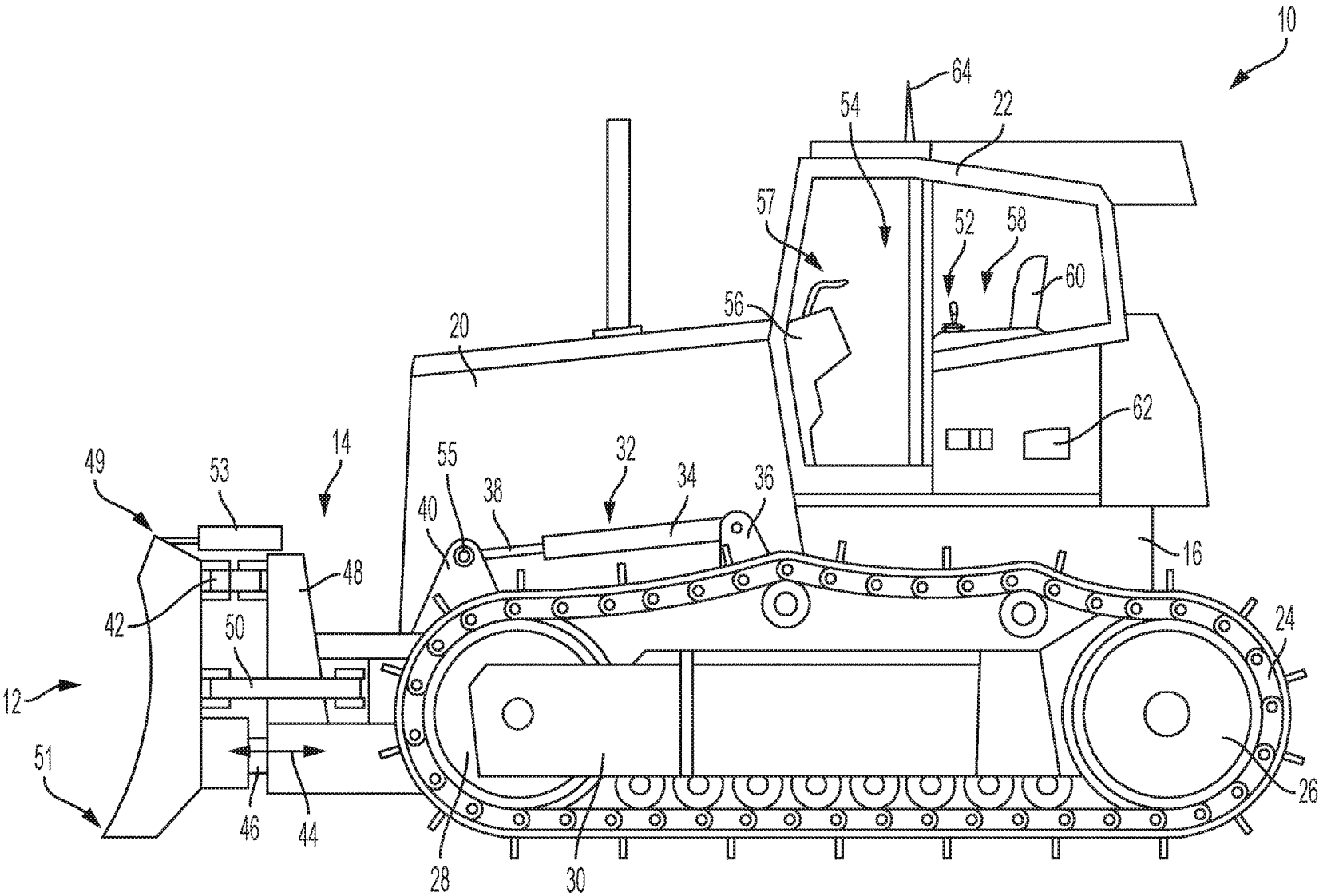
FIG. 1 is an elevational side view of a work vehicle, and more specifically, of a bulldozer such as a crawler dozer including a work implement.

For the purposes of promoting an understanding of the principles of the novel invention, reference will now be made to the embodiments described herein and illustrated in the drawings and specific language will be used to describe the same. It will nevertheless be understood that no limitation of the scope of the novel invention is thereby intended, such alterations and further modifications in the illustrated devices and methods, and such further applications of the principles of the novel invention as illustrated therein being contemplated as would normally occur to one skilled in the art to which the novel invention relates.

FIG. 1 is an elevational side view of a work vehicle 10, such as a crawler bulldozer, including an implement, such as a bulldozer blade 12, which is suitably coupled to the dozer by a linkage assembly 14. Other implements, including mold boards, are contemplated. The vehicle includes a frame or chassis 16 which houses an internal combustion engine (not shown) located within a housing 20. The work vehicle 10 includes a cab 22 where an operator sits to operate the vehicle. The vehicle is driven by a belted track 24 which operatively engages a rear main drive wheel 26 and a front auxiliary drive wheel 28. The belted track is tensioned by tension and recoil assembly 30. The belted track is provided with centering guide lugs for guiding the track across the drive wheels, and grousers for frictionally engaging the ground.

While the described embodiments are discussed with reference to a crawler bulldozer, other work vehicles are contemplated including other types of construction vehicles, forestry vehicles, lawn maintenance vehicles, as well as on-road vehicles such as those used to plow snow. Actuators used in one or more of these work vehicles includes tilt, angle, pitch, lift, arm, boom, bucket, blade side shift, blade tilt, and saddle side shift actuators or actuator cylinders. In these and other vehicles, the operator either sits or stands in the cab and has access to operator controls.

The main drive wheels 26 are operatively coupled to a steering system which is in turn coupled to a transmission. The transmission is operatively coupled to the output of the internal combustion engine. The steering system may be of any conventional design and may be a clutch/brake system, hydrostatic, or differential steer. The transmission may be a power shift transmission having various clutches and brakes that are actuated in response to the operator positioning a shift control lever (not shown) located in the cab 22.

Figure 2:
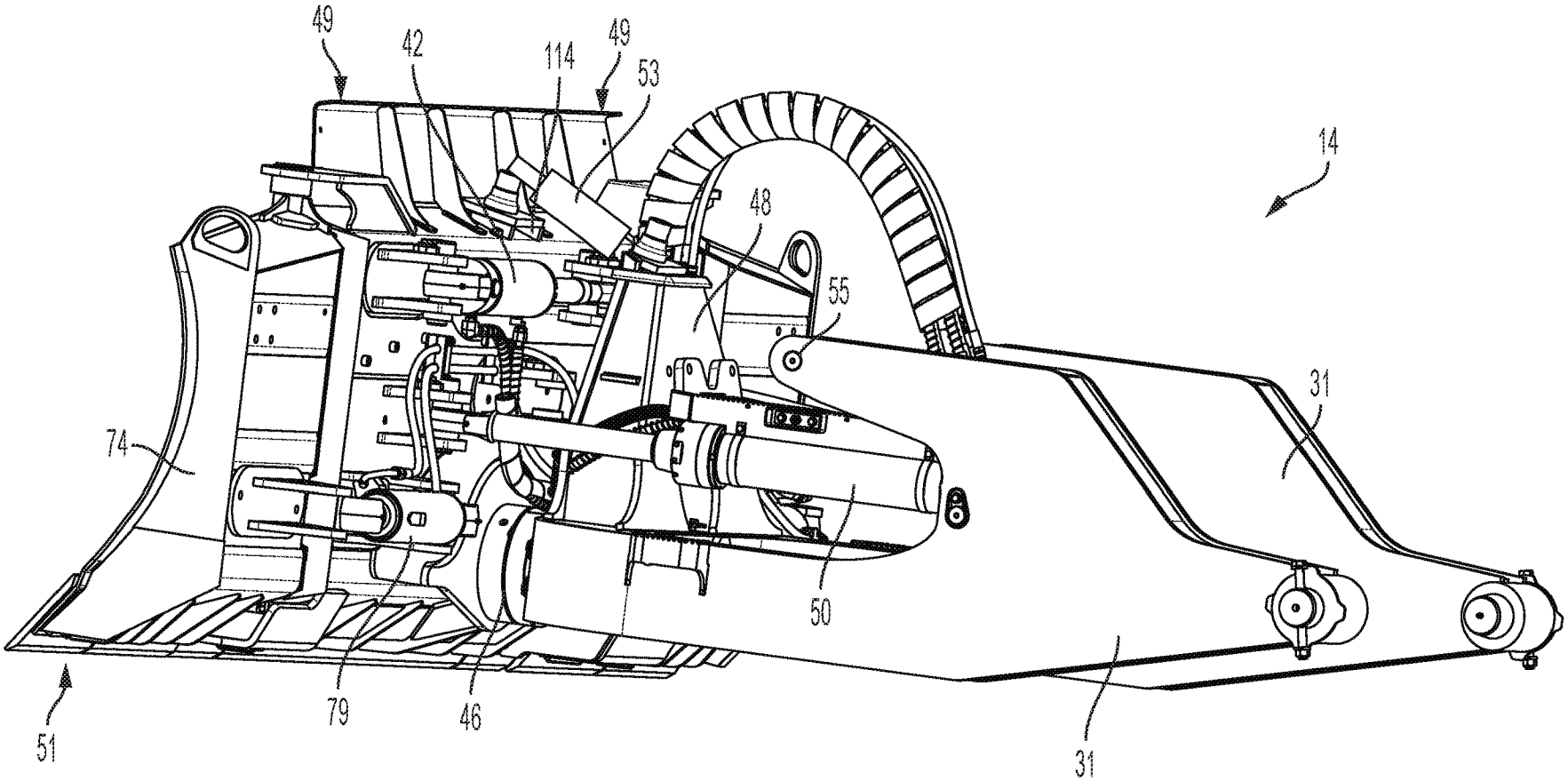
FIG. 2 is a rear perspective view of a work implement, and more particularly a six way blade, having adjustable wings and associated actuators to move the blade with respect to a work vehicle.

The bulldozer blade 12 (the implement) is raised and lowered by the linkage system 14 which includes a number of actuators, such as hydraulic cylinders, to adjust the position of the blade 12. The linkage system 14 includes a C-frame 31, as seen in FIG. 2 as is understood in the art. The C-frame 31 is raised and lowered with respect to the frame 16 by a lift actuator 32 as shown in FIG. 1. The C-frame in FIG. 1 is generically illustrated. A second lift actuator (not shown) is located on another side of the housing 20. In one embodiment, each of the actuators 32 includes a hydraulic actuator including a body, or cylinder 34, rotatably coupled to the frame 16 at a standoff 36, and an arm 38 that extends and retracts from the cylinder 34. The arm 38 is rotatably coupled to a plate 40 that extends from the C-frame to raise and lower the C-frame and therefore the blade 12. Other configurations of raising and lowering the blade 12 are contemplated including vertically oriented lift cylinders.

The blade 12 is tilted relative to work vehicle 10 by the actuation of a tilt cylinder 42 wherein the blade 12 is rotatable about an axis 44 of a spherical bearing 46. For the tilt cylinder 42, a rod end is pivotally connected to a clevis positioned on the back and left sides of blade 12 above the spherical bearing 46. A head end of the tilt cylinder 42 is pivotally connected to an upward projecting portion 48 that extends from the C-frame 31. The opposite end of the tilt cylinder 42 is coupled to a backside of the blade 12. The positioning of the pivotal connections for the head end and the rod end of tilt cylinder 42 result in tilting blade 12 to the left (counterclockwise) or right (clockwise) when viewed from cab 22. Extension of rod of the tilt cylinder 42 tilts the blade counterclockwise. Retraction of tilt cylinder 42 tilts blade 12 to the right or clockwise when viewed from operator's cab 22. In alternative embodiments, blade 12 is tilted by different mechanisms (e.g., an electrical or hydraulic motor). Tilt cylinder 42, in one or more embodiments, is configured differently, such as a configuration in which cylinder 42 is mounted vertically and positioned on the left or right side of blade 12, or a configuration with two tilt cylinders.

Blade 12 is angled relative to work vehicle 10 by the actuation of angle cylinders 50, one of which is illustrated. For each of angle cylinders 50, the rod end is pivotally connected to a blade 12 while the head end is pivotally connected to frame 31. One of angle cylinders 50 is positioned on the left side of work vehicle 10, and the other angle cylinders 50 is positioned on the right side of work vehicle 10. An extension of the left angle cylinder 50 and the retraction of the right of angle cylinder 50 angles blade 12 rightward such that the right side of the blade 12, as viewed from the cab 22, is pulled closer to the cab. Retraction of left angle cylinder 50 and the extension of the right of angle cylinders 50 angles blade 12 leftward, such that the left side of the blade 12 is pulled closer to the cab 22. In alternative embodiments, blade 12 is angled by a different mechanism or angle cylinders 50 are configured differently.

The blade 12 is pitched with respect to the cab 22 with a pitch cylinder 53 connected to the upward projection portion 48, at one end, and connected to the blade 12 at another end. Extension and retraction of the cylinder 53 moves a top edge 49 of the blade 12 toward or away from the cab 12 to achieve the desired pitch. Pitch of the blade 12 is also provided by raising and lowering the C-frame 31 with the lift cylinders 32 (see FIG. 1) having ends coupled to pivot locations 55.

In another embodiment, the pitch cylinder 53 is not included and retraction and extension of the cylinders 50 pitches the blade 12 about the spherical bearing 46.

One or more implement control devices 52, located at a user interface of a workstation 54, are accessible to the operator located in the cab 22. The user workstation includes a front console 56, supporting a grab bar 57 located at a forward portion of the cab 22, and a workstation 58 located at or near the arms of an operators chair 60. The control devices 52 are operatively connected to a controller 62. The controller 62 receives signals from the control devices 52 to adjust the positon of the blade 12. In other embodiments, the implement control devices are located at the front console 56 or at the front console 56 and the workstation 58.

The control devices 52 are located at a user interface that includes a plurality of operator selectable buttons, switches, joysticks, and toggles configured to enable the operator to control the operations and functions of the vehicle 10. The user interface, in one embodiment, includes a user interface device including a display screen having a plurality of user selectable buttons to select from a plurality of commands or menus, each of which are selectable through a touch screen having a display. In another embodiment, the user interface includes a plurality of mechanical push buttons as well as a touch screen. In still another embodiment, the user interface includes a display screen and only mechanical push buttons. In one or more embodiments, adjustment of blade with respect to the frame is made using one or more levers or joysticks.

Figure 5:
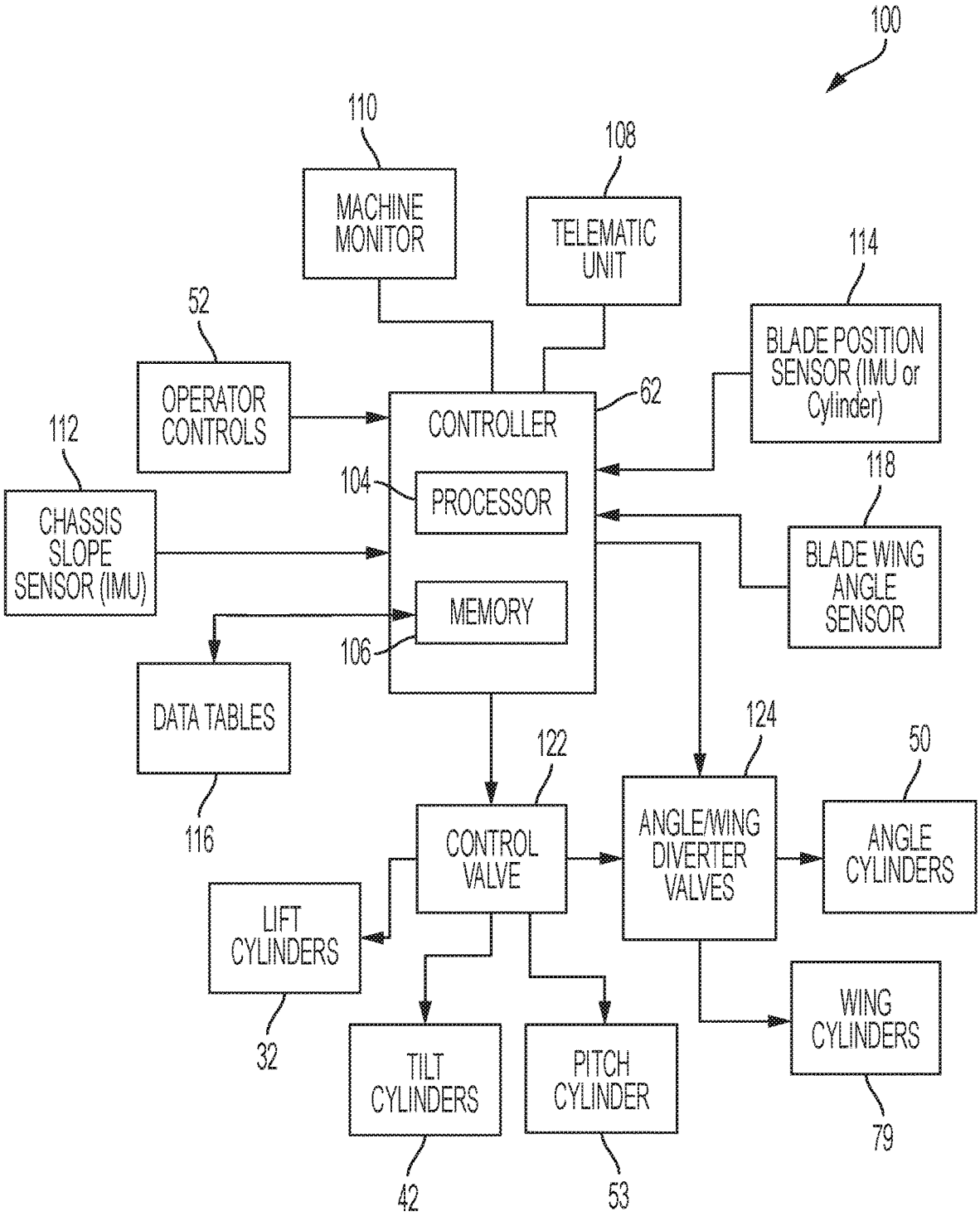
FIG. 5 is a schematic block diagram of a control system configured control the position of an implement, and more particularly to control the position of a blade having adjustable wings.

Adjustment of the actuators 32, 42, and 50 is made by the operator using the control devices 52 which are operably coupled to the controller 62, as seen in FIG. 5, which in one embodiment, is located within the frame 16. Other locations of the controller 62 are contemplated including the cab 22. The control devices 52 are operatively connected to the controller 62 which is operative to adjust the lift cylinders 32, tilt cylinders 42, the angle cylinders 50, and the pitch cylinder 53. Adjustment of one or more of the control devices generates a commanded position received by the controller 62 which identifies to the controller 62 a direction and final position of the blade to achieve a desired grading operation.

In FIG. 1, an antenna 64 is located at a top portion of the cab 22 and is configured to receive and to transmit signals from different types of machine control systems and or machine information systems including a global positioning systems (GPS). While the antenna 64 is illustrated at a top portion of the cab 22, other locations of the antenna 64 are contemplated as is known by those skilled in the art.

Figure 3:
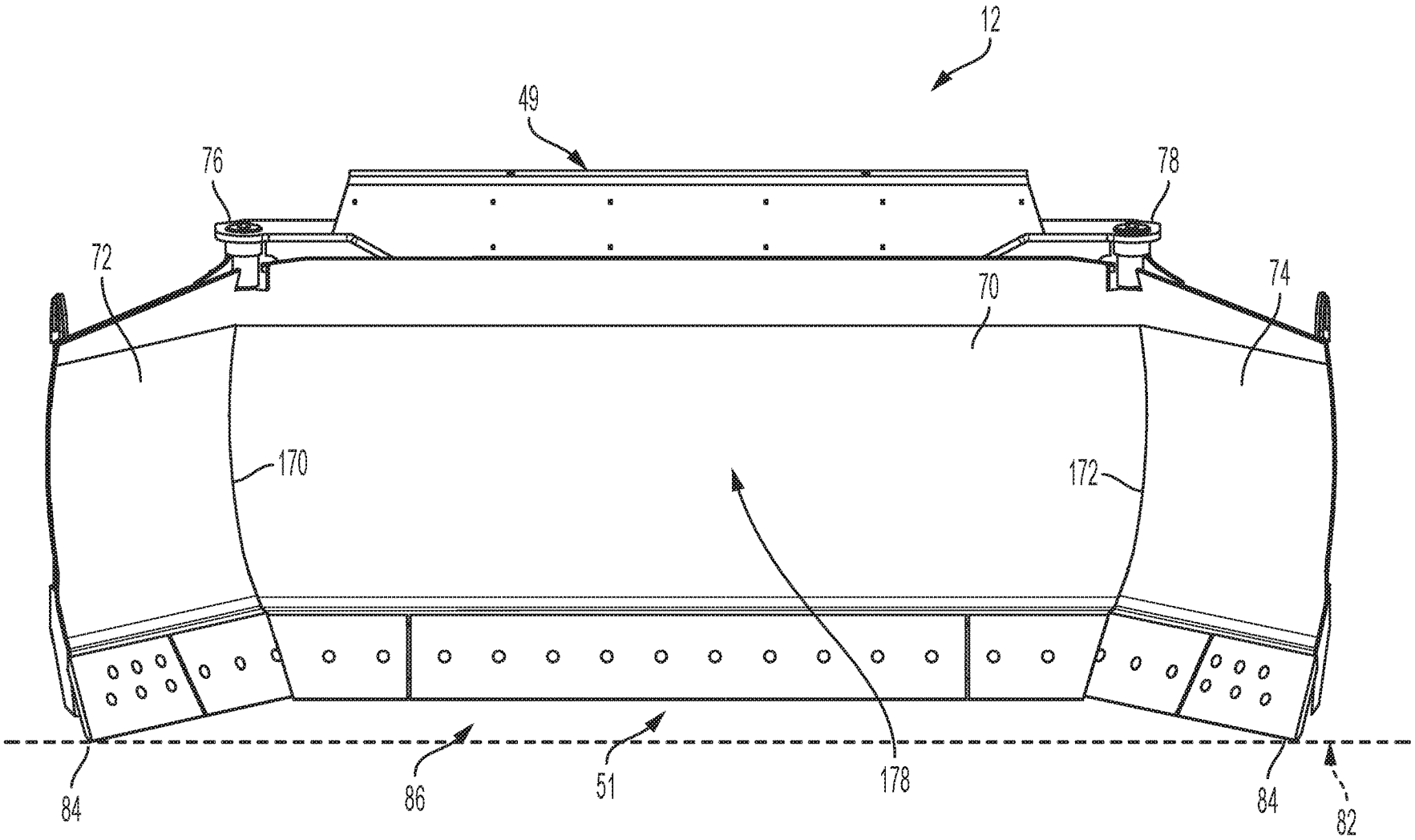
FIG. 3 is a front view of a blade in a forwardly pitched position.
Figure 4:
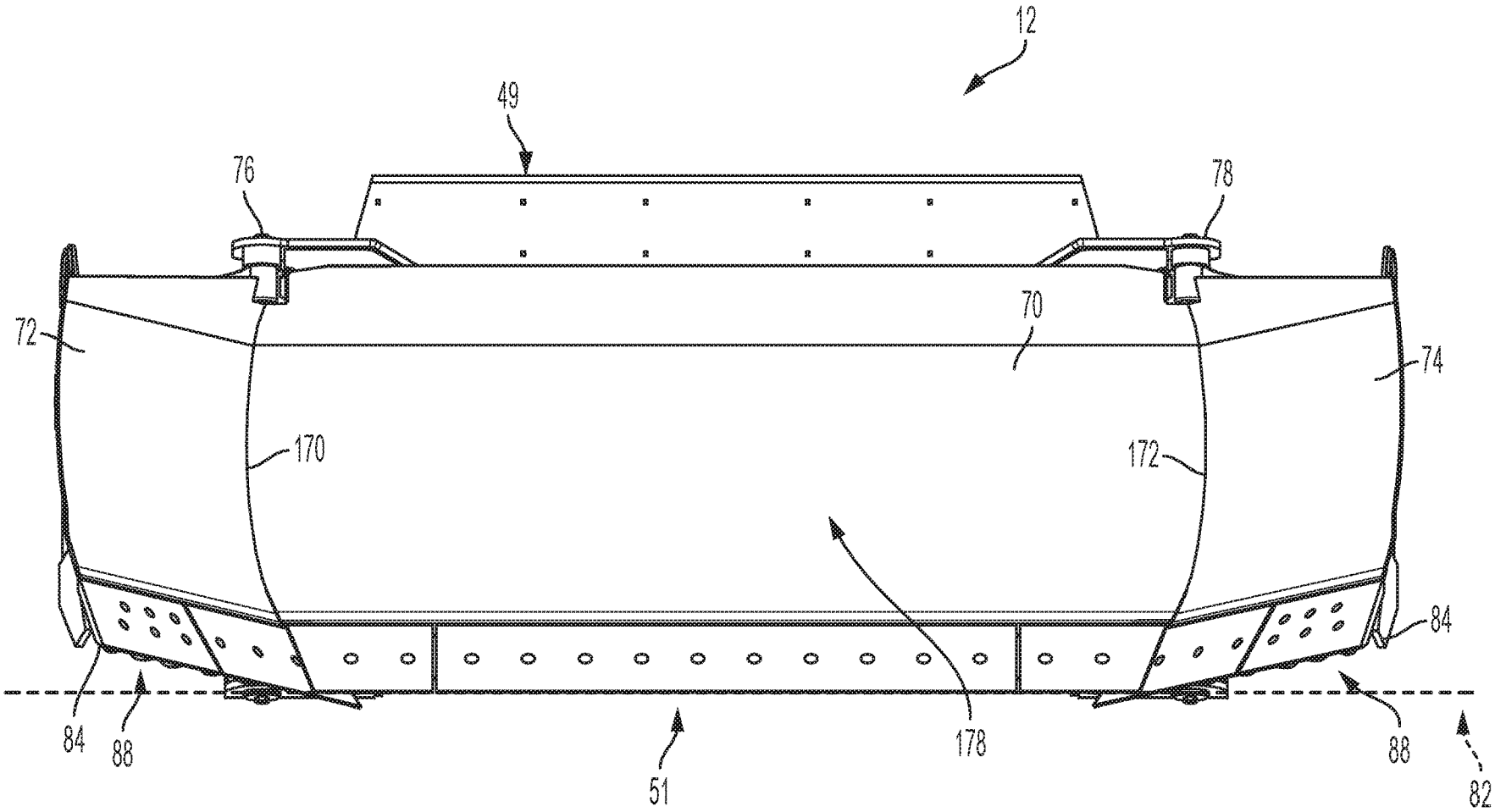
FIG. 4 is a front view of a blade in a rearwardly pitched position.

The blade 12, as illustrated in FIGS. 3 and 4, includes a center portion 70, a first wing 72 rotatably connected to one side of the center portion 70, and a second wing 74 rotatably coupled to another side of the center portion 70. Each of the first and second wings 72 and 74 are respectively rotatably coupled to the center portion 70 at a first hinge 76 and a second hinge 78. Each wing 72 and 74 is adjustably moved by a wing actuator 79 as illustrated in FIG. 2. Each of the FIGS. 3 and 4 illustrate the wings 72 and 74 being folded in or toward a path traveled by the vehicle 10. If each wing 72 and 74 is not folded in but is substantially planar with the center portion 70 as illustrated in FIG. 1, the bottom edge 51 of the entire blade 12 extending from one wing to the other wing is substantially planar with respect to a ground surface 82 and is in contact with the ground surface 82 when lowered sufficiently. If, however, the wings 72 and 74 are folded in, and the pitch of the blade 12 remains the same as illustrated in FIG. 1, the entire edge 51 from wing to wing remains in contact with the ground when lowered.

As illustrated in FIG. 3, should blade 12 be pitched forward, only a leading end point 84 of each wing contacts the ground 82. In this condition, a gap 86 appears between the center portion 70 of the blade and the ground 82, and material to be moved by the blade 12 moves through the gap 86, which reduces the effectiveness of a blade operation. Materials to be moved include dirt, soil, aggregate, snow, and ice to a desired location. Other materials are contemplated.

Also, as illustrated in FIG. 4, if the blade 12 is pitched towards the rear without raising the blade 12, only the bottom edge 51 contacts the ground 82, and the leading end points 84 are raised with respect to the ground 82. In this condition, a gap 88 appears between the end points 84 of the blade and the ground 82. Some of the material to be moved by blade 12 consequently moves through the gaps 88 which reduces the effectiveness of a blade operation.

As illustrated by both FIGS. 3 and 4 the blade contact point to the ground on a straight blade or a blade having wings oriented in the same fashion as a straight blade is a point, when viewed from the side, or a straight edge, when viewed from the front. Even with the blade all the way down at the surface 82 and with the wings 72 and 74 not being inclined with respect to the center blade 70, the edge 51 from wing to wing contacts the ground at the same time. With a folding blade, however, as illustrated in FIGS. 3 and 4, any amount of folding of the wing sections 72 or 74, makes the edge 51 contact the ground 82 in only one pitch position of the blade. When the blade is pitched forward or backward, from a nominal level of FIG. 2, the wings 72 or 72 cutting edges are not contacting the ground on the same level as the wings center portion's cutting edge For instance as seen in FIG. 3, the leading edge of the wing's cutting edge is cutting deeper into the ground than the center portion's cutting edge.

To overcome the gaps which are located at the center blade or at the wings, an operator must adjust the pitch of the blade so that the edges of the wings 72 and 74 match the level of the edge of the center portion 70. Because the cutting edges of the blade 12 can be difficult to see by an operator, alignment of the blade 12 with respect to the ground 82 can be very difficult. Such an operation requires extreme concentration, even for an expert operator. In fact, under some conditions where ground conditions and weather conditions are not optimal, correctly placing the blade 12 is next to impossible. Similarly, due to geometry of the ball joint 46 between the blade 12 and the C-frame 31, tilting the blade 12 can affect the pitch of the blade.

To overcome the deficiencies presented by grading a surface with a blade having wings, the present disclosure includes a control system 100 illustrated in FIG. 5, which maintains the positions of the blade 12 with respect to the ground 82 when the wings 72 and 74 are inclined with respect to the center portion 70. By automatically adjusting the position of the blade in response to an operator's control input, the edge of the blade from one wing, to the center portion of the blade, and to the other wing is maintained substantially along a plane identified by the operator control to perform a grading operation.

As seen in FIG. 5, the control system 100 includes the controller 62 which includes a processor 104 and a memory 106. In other embodiments, the controller 62 is a distributed controller having separate individual controllers distributed at different locations on the vehicle 10. In addition, the controller is generally hardwired by electrical wiring or cabling to related components. In other embodiments, however, the controller 62 includes a wireless transmitter and/or receiver to communicate with a controlled or sensing component or device which either provides information to the controller or transmits controller information to controlled devices.

The controller 62, in different embodiments, includes a computer, computer system, or other programmable devices. In other embodiments, the controller 62 includes one or more processors 104 (e.g. microprocessors), and the associated memory 106, which can be internal to the processor or external to the processor. The memory 106 includes, in one or more embodiments, random access memory (RAM) devices comprising the memory storage of the controller 62, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to controller 62. The mass storage device can include a cache or other dataspace which can include databases. Memory storage, in other embodiments, is located in the "cloud", where the memory is located at a distant location which provides the stored information wirelessly to the controller 62.

The controller 62 executes or otherwise relies upon computer software applications, components, programs, objects, modules, or data structures, etc. Software routines resident in the included memory 106 of the controller 62, or other memory, are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices that execute the instructions resident in memory, which are responsive to other instructions generated by the system, or which are provided at a user interface operated by the user. The processor 104 is configured to execute the stored program instructions as well as to access data stored in one or more data tables. A telematic unit 108, or a transmitter and/or receiver, is operatively connected to the antenna 64 to receive and transmit information wirelessly through cellular communication or other types of communication, including satellite.

The processor 104 and the memory 106 are configured to monitor the position of the wings 72 and 74, and when either of the wings 72 or 74 are rotated forward, the controller 62 commands the pitch of the blade 12 to maintain the edge 51 of the blade from wing to wing along a plane. The commanded pitch is based on the currently sensed blade position to keep the leading edge of the wings' cutting edge on the same level of the center portion of the blades cutting edge, thereby, maintaining the grade. When the wings 72 and 74 are articulated at other than parallel with respect to the center portion 70, the controller 62 adjusts the pitch of the blade 12 with respect to ground based on inputs from the operator controls and from the sensor inputs to adjust the pitch the blade, which adjusts the cutting edge of the blade from one wing to the other wing. In different embodiments, each wing 72 or 74 is individually controllable such that the angle of one wing is different than the angle of the other wing.

The vehicle 10 includes a machine monitor 110 which, in different embodiments, includes one or more cameras located on the vehicle, and a visual display screen, located in the cab 22, to display the vehicle, including the vehicle's position with respect to ground, such as direction, slope, and position within a work area being graded. Chassis slope is provided by a chassis slope sensor 112, such as an inertial measurement unit (IMU), which transmits slope signals to the controller 62, which in one or more embodiments, are used by the processor 104 to adjust the blade position. Additional blade information is provided by a blade position sensor 114, which in different embodiments includes an IMU or a cylinder sensor. In one embodiment, a cylinder sensor includes an internal sensor which determines the amount of extension of a cylinder arm from a cylinder body. The resulting signal is received at the processor 104 and used to determine blade position. In one embodiment, one or more data tables 116 include kinematic information, which in combination with the blade position signal received from the sensor 114, determines blade position.

Each of the wings 72 and 74, that is moved by one of the wing cylinders 79, includes a blade wing angle position sensor 118. In one embodiment, the sensor 118 is located at the pivot location about which the wing pivots, such as a rotary angle sensor. In another embodiment, a cylinder sensor determines the extension of the wing cylinder arm from the wing cylinder used to determine wing angle. Other sensors are contemplated.

Each of the lift cylinders 32, the tilt cylinders 42, and the pitch cylinder 53, are coupled to control valves 122 to move the appropriate cylinder as directed by the operator controls 52. Angle/wing diverter valves 124 are operatively connected to the wing cylinders 79 as is understood by one skilled in the art.

The processor 104 receives status and position signals from each of the sensors, the IMUs, or cylinder position sensors, and determines the position of the blade 12 based on those input signals. The memory 106 includes a kinematic model of the blade 12 and the geometry of the C-frame 31. The processor 104 determines, based on the program instructions, when to position the blade, how much to position the blade, and the final location of the blade 12 based the user controls 52 that provide the direction and magnitude of the blade lift, tilt and/or pitch valve commands. Upon determining, these values, the pitch of the blade is adjusted automatically such that each of the cutting edges of the wings 72, 74, and the center blade 70, are located substantially level with the surface being graded. In another embodiment, the wings 72 and 74 are adjusted as well as the blade pitch by commanding positions of wings at the same time as the blade lift/tilt to improve performance and to make a smooth cut without the wing edges cutting into grade or being raised above the grade.

Figure 6:
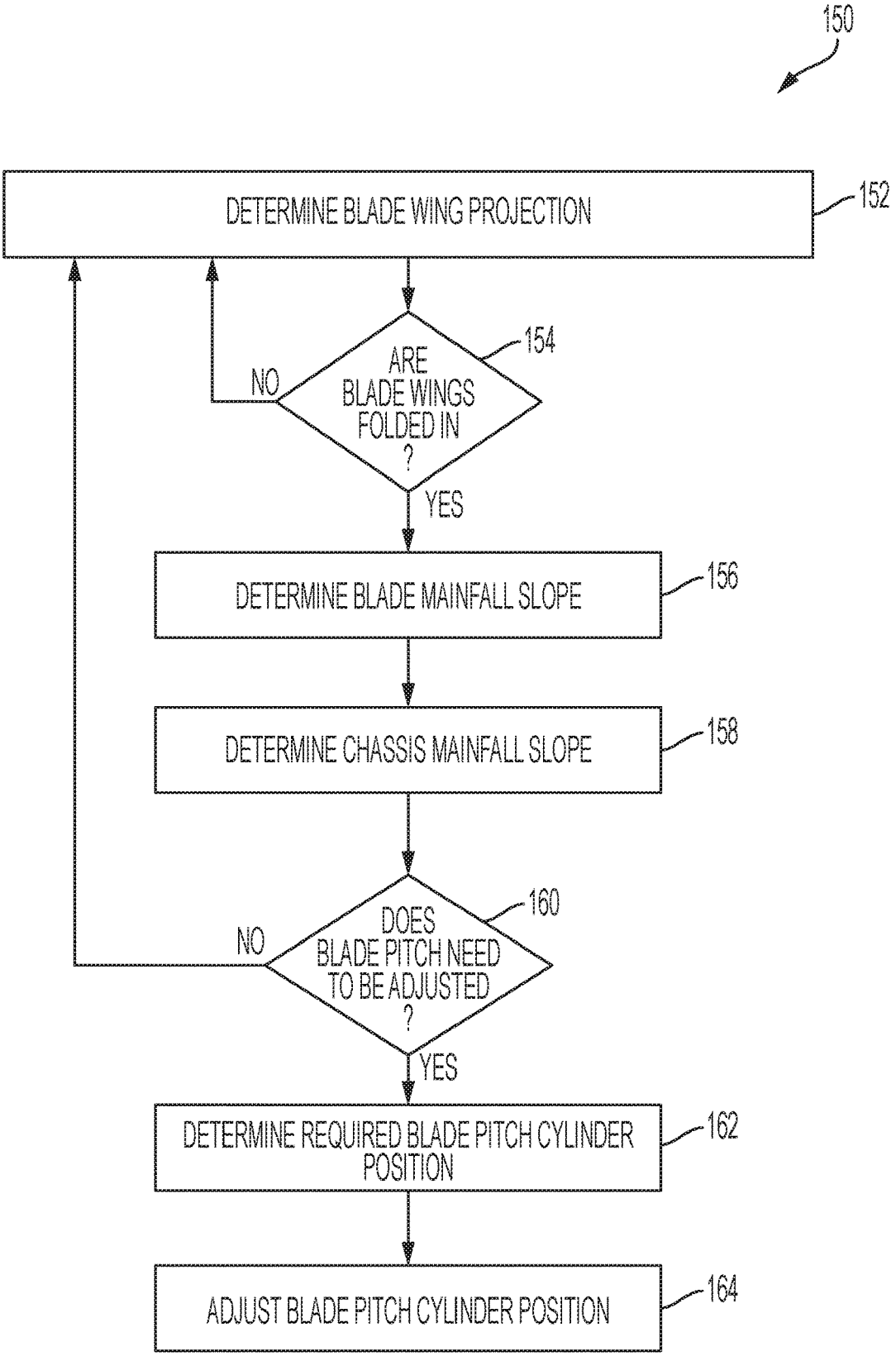
FIG. 6 is a process diagram to automatically adjust a position of a blade based on a position of a wing extending from a central portion of the blade.

FIG. 6 illustrates a block diagram 150 of a process to automatically position the blade 12 based on the position of the wings 72 and 74 in response to an operator's blade command. Initially, at block 152, the controller 62 determines the position of the wings 72 and 74. In one embodiment, the position of each wing 72 and 74 with the center portion 70 is the same. Once the blade wing projection is determined at block 152, the determined value is compared to non-inclined position of the wings to determine if the wings are inclined ("folded in" toward the direction of travel) at block 154. If not, the process returns to block 152 to determine when the wings are folded in. If the wings are folded in at block 154, a blade mainfall slope is identified by the blade position sensor 114 at block 156. The blade mainfall slope identifies the slope of the cutting edge 51 of the central portion of the blade 70. This value of blade mainfall slope is stored in memory 106, or other storage locations. At block 158, a chassis mainfall slope is determined and stored in memory 106. The chassis mainfall slope identifies a slope of the vehicle in the direction of vehicle travel with respect to gravity. Once the values of blade mainfall slope and chassis mainfall slope are determined, the controller 62 determines at block 160 whether the pitch of the blade 12 needs to be adjusted to maintain the blade edge, including the wing edges, at a location being substantially parallel to the surface, and in particular to the intended grade being prepared by the operator using the control devices 52. If the blade pitch should be adjusted as determined at block 160, the controller 62 determines the required blade pitch to achieve the commanded position of the blade 12 at block 162. In one more embodiments the commanded blade signal is modified by the controller 62 to achieve a blade pitch that aligns the edges of the wings and the central portion of the blade with the intended grade. Once the required blade position is determined, the blade pitch is adjusted, when needed, at block 164.

The process of adjusting the blade pitch, based on wing position, is made as the operator moves the blade up or down, adjusts the tilt of the blade, or the angle of the blade. The vehicle control system automatically adjusts the pitch of the blade in response to the operator's commands transmitted by the operator controls, so that the leading edge of the wings' cutting edges are on the same level of the center portion's cutting edge, thereby maintaining grade. The shape of the wings pivot locations 76 and 78 with respect to the main blade assembly 70 together with overlapping protruding curves 170 and 172 of the blade assembly 12 minimizes the gap between ground and the blade in such a way as to restrict material from passing through or beneath the wings or the center portion of the blade. The overlapping protruding curves 170 and 172 are each edges of a metal sheet 178 forming the front surface of the blade 12.

Figure 7:
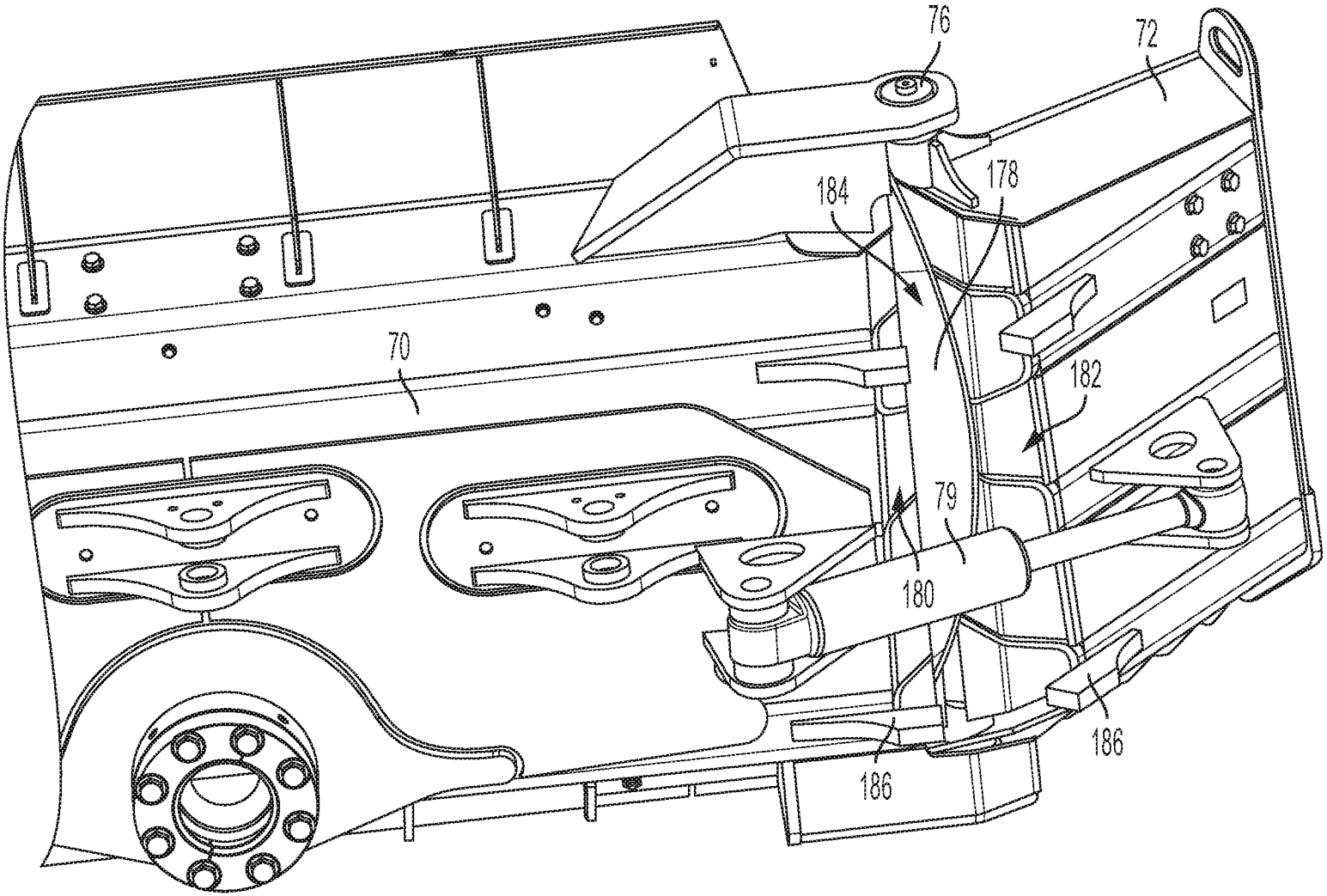
FIG. 7 is a rear view of a blade having a wing located in a forward or folded-in position.

FIG. 7 is a rear view of the blade assembly 12 having wing 72 located in a forward or folded in position. The actuator 79 is extended to incline the wing 72 with respect to the center portion 70 of the blade 12. In this position, a frame 180 of the center portion 70 is spaced from a frame 182 of the wing 72, such that a gap 184 is located between each frame 180 and 182. The gap 184, however, is substantially closed off at the front of the blade 12 by the end of the metal sheet as seen in FIG. 7. See also the front views of FIGS. 3 and 4. When the wings 70 and 72 are planar with the center portion 70, the metal sheet 178 extends over a metal sheet defining the front surface of the wings. When the wings 70 and 72 are inclined, however, the metal sheet 178 covers the gap 184 and substantially prevents material from moving though the gap 184. Because the front surfaces of the middle portion 70 and the wings 72 and 74 are concave, the overlapping ends of the center portion material is not substantially deformed by the inclination of the wings. The blade 12 includes blocking structures 186 to prevent further movement of the wings with respect to the center portion 70 when the wings are not inclined.

While exemplary embodiments incorporating the principles of the present disclosure have been described hereinabove, the present disclosure is not limited to the described embodiments. Instead, this application is intended to cover any variations, uses, or adaptations of the disclosure using its general principles. In addition, while the terms greater than and less than have been used in making comparison, it is understood that either of the less than or greater than determines can include the determination of being equal to a value. Further, this application is intended to cover such departures from the present disclosure as come within known or customary practice in the art to which this disclosure pertains and which fall within the limits of the appended claims.

The invention claimed is:

1. A method of positioning a blade with respect to a work vehicle having an operator control to position the blade, the blade including a central portion and an adjustable wing, the method comprising:

receiving a blade positioning signal from an operator control;

identifying a wing position of the wing when inclined with respect to the central portion of the blade based on the blade positioning signal received from the operator control;

identifying a commanded blade position based on the blade positioning signal received from the operator control; and automatically adjusting a pitch of the blade based on the wing position when inclined and the commanded blade position, wherein the automatically adjusting the pitch of the blade aligns a cutting edge of the wing and a cutting edge of the central portion of the blade substantially along a plane.

2. The method of claim 1 wherein the automatically adjusting the position of the blade further includes wherein the plane is determined by the blade positioning signal.

3. The method of claim 2 further comprising identifying a position of the blade with respect to the work vehicle, and wherein the automatically adjusting the pitch of the blade further includes automatically adjusting the pitch of the blade based on the position of the blade with respect to the work vehicle.

4. The method of claim 3 wherein the identifying a position of the blade with respect to the work vehicle includes identifying a slope of the work vehicle along a direction of travel.

5. The method of claim 4 wherein the automatically adjusting the pitch of the blade further includes automatically adjusting the pitch of the blade based on the identified slope of the work vehicle.

6. The method of claim 3 wherein the blade positioning signal includes determining a position of an arm of a blade pitch cylinder to move the blade to the identified blade position.

7. The method of claim 6 wherein the automatically adjusting the pitch of the blade includes automatically adjusting the arm of the blade pitch cylinder to move the blade to the pitch of the blade.

8. A work vehicle comprising:

a chassis;

a blade including a wing and a central portion;

a linkage system connected to the chassis and to the blade, wherein the linkage system is configured to position of the blade with respect to the chassis;

an operator control adapted to provide a blade positioning signal; and a controller operatively connected to the operator control and to the linkage system, the controller including a processor and a memory, wherein the memory is configured to store program instructions and the processor is configured to execute the stored program instructions to:

identify a wing position of the wing when inclined with respect to the central portion of the blade based on the blade positioning signal;

identify a commanded blade position based on the blade positioning signal received from the operator control; and automatically adjust a pitch of the blade based on the wing position when inclined and the blade positioning signal, wherein the automatically adjusting the pitch of the blade aligns a cutting edge of the wing and a cutting edge of the central portion of the blade substantially along a plane.

9. The work vehicle of claim 8 wherein the plane is determined by the blade positioning signal.

10. The work vehicle of claim 9 wherein the processor is further configured to execute the stored program instruction to:

identify a position of the blade with respect to the work vehicle; and automatically adjust the pitch of the blade based on the position of the blade with respect to the work vehicle.

11. The work vehicle of claim 10 wherein the processor is further configured to execute the stored program instruction to:

identify a vehicle slope of the work vehicle along a direction of travel when identifying the pitch of the blade with respect to the work vehicle.

12. The work vehicle of claim 11 wherein the processor is further configured to execute the stored program instruction to:

automatically adjust the pitch of the blade based on the identified slope of the work vehicle.

13. The work vehicle of claim 10 wherein the processor is further configured to execute the stored program instruction to:

determine a position of an arm of a blade pitch cylinder to move the blade to the identified blade position.

14. The work vehicle of claim 13 wherein the processor is further configured to execute the stored program instructions to:

automatically adjust the arm of the blade pitch cylinder based on the determined position of the arm of the blade pitch cylinder.

15. The work vehicle of claim 11 wherein the processor is further configured to execute the stored program instruction to:

identify a blade slope of the blade along a direction of travel when identifying the position of the blade with respect to the work vehicle; and automatically adjust the pitch of the blade based on the identified vehicle slope of the vehicle and on the identified blade slope of the blade, wherein each of the vehicle slope and the blade slope are determined by an inertial measurement unit.

16. A method of moving materials with a blade having an adjustable wing located at one end of a center portion of the blade, the blade operatively connected to a work vehicle, the blade being positionable with respect to the work vehicle in response to an operator command, the method comprising:

identifying a commanded position of the blade based on a blade positioning signal received from the operator command;

identifying a wing position of the adjustable wing in an inclined position with respect to the center portion of the blade based on the identified commanded position of the blade;

automatically adjusting a pitch of the blade with respect to the work vehicle based on the identified wing position of the adjustable wing in the inclined position and the identified commanded position of the blade wherein the automatically adjusting the pitch of the blade aligns a wing cutting edge with a central portion cutting edge of the blade substantially along a plane for an intended grade being prepared by an operator provided by the operator command.

17. The method of claim 16 further comprising identifying a vehicle slope of the work vehicle along a direction of travel, and wherein the automatically adjusting a pitch of the blade includes automatically adjusting the pitch of the blade based on the identified slope of the work vehicle.

18. The method of claim 17 further comprising identifying a blade slope of the blade along a direction of travel of the work vehicle, and wherein the automatically adjusting a pitch of the blade includes automatically adjusting the pitch of the blade based on the identified blade slope of the blade.

* * * * *